US008672703B2

(12) United States Patent
Fehling et al.

(10) Patent No.: US 8,672,703 B2
(45) Date of Patent: Mar. 18, 2014

(54) SPRING TERMINAL, IN PARTICULAR A FRONT TERMINAL

(75) Inventors: Stephan Fehling, Lage (DE); Constantin Classen, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 67 days.

(21) Appl. No.: 13/517,343

(22) PCT Filed: Dec. 17, 2010

(86) PCT No.: PCT/EP2010/070075
§ 371 (c)(1),
(2), (4) Date: Jun. 20, 2012

(87) PCT Pub. No.: WO2011/083031
PCT Pub. Date: Jul. 14, 2011

(65) Prior Publication Data

US 2012/0258615 A1 Oct. 11, 2012

(30) Foreign Application Priority Data

Jan. 7, 2010 (DE) ..... 20 2010 000 681 U

(51) Int. Cl.
*H01R 11/20* (2006.01)

(52) U.S. Cl.
USPC ..... 439/417; 439/441

(58) Field of Classification Search
USPC ..... 439/417, 441, 268, 835
See application file for complete search history.

(56) References Cited

U.S. PATENT DOCUMENTS

| | | | | |
|---|---|---|---|---|
| 5,324,213 | A * | 6/1994 | Frantz | 439/441 |
| 6,244,904 | B1 * | 6/2001 | Fabian et al. | 439/656 |
| 6,254,422 | B1 * | 7/2001 | Feye-Hohmann | 439/441 |
| 7,074,054 | B2 * | 7/2006 | Mertz et al. | 439/78 |
| 7,431,603 | B1 * | 10/2008 | Szmidt | 439/289 |
| 8,358,586 | B2 * | 1/2013 | Toda et al. | 370/252 |
| 8,430,674 | B2 * | 4/2013 | Pichard et al. | 439/44 |
| 8,550,838 | B2 * | 10/2013 | Osagle et al. | 439/441 |

(Continued)

FOREIGN PATENT DOCUMENTS

| | | |
|---|---|---|
| DE | 19 02 066 U | 10/1964 |
| DE | 81 37 617 U1 | 5/1982 |

(Continued)

*Primary Examiner* — Neil Abrams
*Assistant Examiner* — Phuongchi T Nguyen
(74) *Attorney, Agent, or Firm* — Lawrence E. Laubscher, Sr.; Lawrence E. Laubscher, Jr.; Robert D. Spendlove

(57) ABSTRACT

An electrical connector for connecting the bare end of an insulated conductor with a circuit on a printed circuit board, including a horizontal printed circuit board having an electrical circuit thereon, an electrically conductive contact arrangement mounted on, and electrically connected with the circuit of, the printed circuit board, the contact arrangement including at least two spaced resilient contacts having adjacent end portions that are biased together, a housing formed from electrically insulating material and containing a conductor opening for receiving the conductor bare end; and a positioning arrangement operable by an actuating tool for positioning the conductor bare end in a clamped position between the contact end portions. When the contact arrangement is in the form of a pair of leaf spring contacts connected in a V-shaped manner, an adjusting device is provided for adjusting the space between the adjacent ends of the contacts.

19 Claims, 16 Drawing Sheets

(56) References Cited

U.S. PATENT DOCUMENTS

| | | | | |
|---|---|---|---|---|
| 2003/0027451 | A1* | 2/2003 | Bernat et al. | 439/391 |
| 2003/0171023 | A1* | 9/2003 | Turek et al. | 439/395 |
| 2006/0160404 | A1* | 7/2006 | Alarcon et al. | 439/409 |
| 2006/0199439 | A1* | 9/2006 | Mertz et al. | 439/709 |
| 2006/0266196 | A1* | 11/2006 | Hanning et al. | 84/313 |

FOREIGN PATENT DOCUMENTS

| | | | |
|---|---|---|---|
| DE | 87 10 741.4 | U1 | 11/1987 |
| DE | 197 35 835 | B4 | 2/1999 |
| DE | 198 38 008 | A1 | 3/1999 |
| DE | 100 40 484 | C2 | 3/2002 |
| DE | 10 2006 018 129 | A1 | 11/2007 |

* cited by examiner

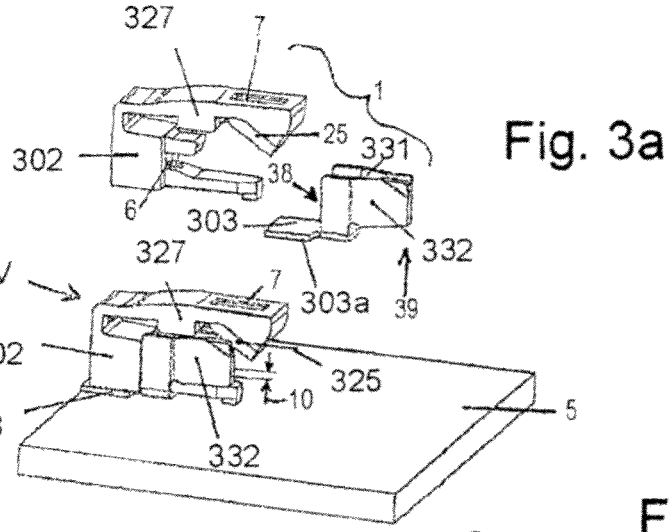
Fig. 3a
Fig. 3b
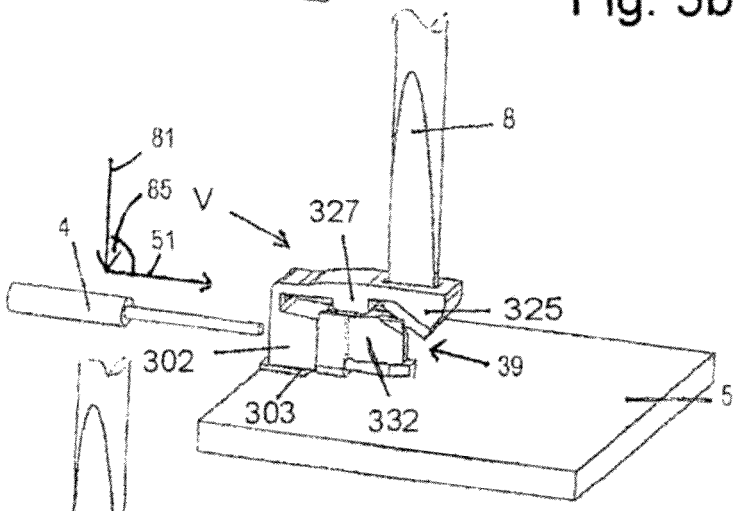
Fig. 3c
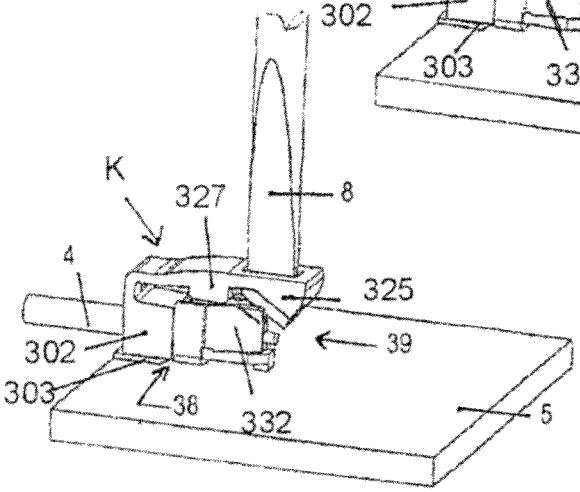
Fig. 3d

Fig. 7a
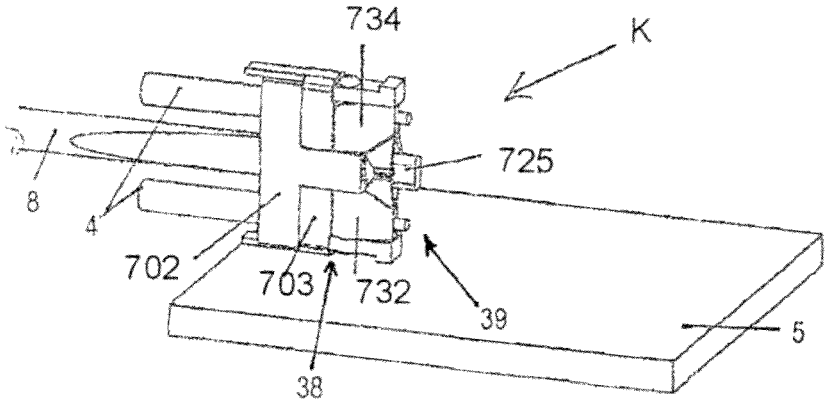
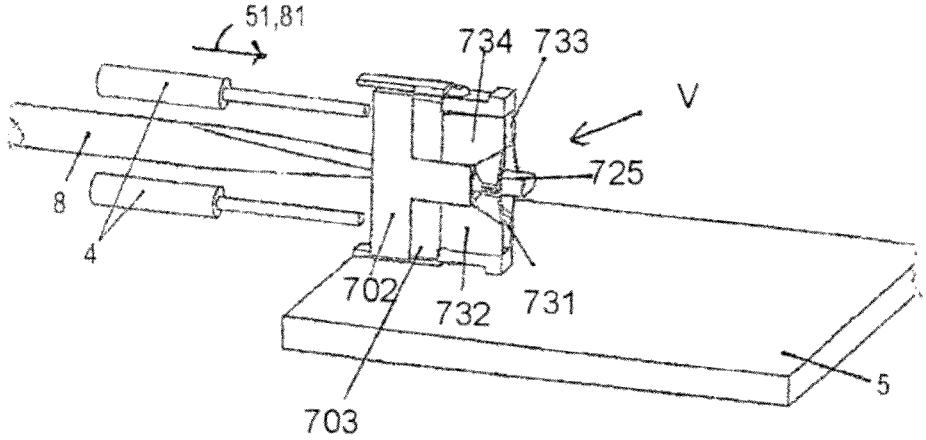
Fig. 7b

SPRING TERMINAL, IN PARTICULAR A FRONT TERMINAL

REFERENCE TO RELATED APPLICATIONS

This application is a national stage application under 35 U.S.C. §371 of PCT International Application No. PCT/EP2010/070075 filed Dec. 17, 2010, claiming priority of the German application No. 20 2010 000 681.3 filed Jan. 7, 2010.

BACKGROUND OF THE INVENTION

1. Field of the Invention

An electrical connector for connecting the bare end of an insulated conductor with a circuit on a printed circuit board, including a horizontal printed circuit board having an electrical circuit thereon, an electrically conductive contact arrangement mounted on, and electrically connected with the circuit of, the printed circuit board, the contact arrangement including at least two spaced resilient contacts having adjacent end portions that are biased together, a housing formed from electrically insulating material and containing a conductor opening for receiving the conductor bare end; and a positioning arrangement operable by an actuating tool, such as a screwdriver, for positioning the conductor bare end in a clamped position between the contact end portions.

2. Description of Related Art

In the case of spring terminals, an electrical conductor is mostly pressed against a busbar and is clamped by means of a clamping body. In the process, at least one restoring force, generated by means of a spring, acts upon the clamping body, which, for example, can be adjusted by means of a screw so that the clamping body, as the screw is reset, can again be separated from the conductor. Such a spring terminal with a clamping body that can be adjusted by means of a screw is shown by way of example in publication EP 0 836 242 B1.

In the case of spring force terminals, the conductor, on the other hand, is pressed against an electrically conducting abutment by means of a leaf spring. Such a spring force terminal, for example, is shown in publication DE 20 2005 08168.

The above-mentioned spring terminals and spring force terminals commonly share the fact that, along with the conductor and the bus bar, much structural space is required for the structural parts, especially for clamping bodies and clamping springs that, as such, are not involved in the conduction of the current. To some extent, these parts considerably enlarge the dimensions of the terminals. There is a tendency to make electrical appliances ever smaller; therefore, however, there is a considerable requirement for electrical connection elements with miniaturized dimensions.

In the case of such small connection elements, the parts are accordingly small so that they are difficult, both in terms of their production and when the user wants to use them to connect a conductor.

SUMMARY OF THE INVENTION

Accordingly, the primary object of the present invention therefore is to create a very space-saving electrical connection element that will facilitate the connection of a conductor with a few simple parts and that can therefore be easily handled in terms of its utilization and that is furthermore produced in a very simple and inexpensive manner.

A more specific object of the invention is to provide an electrical connector for connecting the bare end of an insulated conductor with a circuit on a printed circuit board, including a horizontal printed circuit board having an electrical circuit thereon, an electrically conductive contact arrangement mounted on, and electrically connected with the circuit of, the printed circuit board, the contact arrangement including at least two spaced resilient contacts having adjacent end portions that are biased together, a housing formed from electrically insulating material and containing a conductor opening for receiving the conductor bare end; and a positioning arrangement operable by an actuating tool for positioning the conductor bare end in a clamped position between the contact end portions. When the contact arrangement is in the form of a pair of leaf spring contacts connected in a V-shaped manner, an adjusting device is provided for adjusting the space between the adjacent ends of the contacts.

This object is solved with a spring terminal, especially a front terminal for the connection of an electrical conductor with an electrical subassembly with a contact part and with a housing part, whereby, for the purpose of connection with the contact part, the electrical conductor can be stuck into the housing part, whereby the spring terminal has an insertion opening for an actuation means, especially a screwdriver, whereby the contact part comprises a clamping jaw that by means of the actuation member can be adjusted from a shifting state in which the conductor is not clamped together with the clamping jaw into a clamping state in which the conductor is clamped together with the clamping jaw, whereby the clamping jaw conducts current.

According to the invention the contact part that conducts current is provided for the purpose of connecting the conductor with the electrical subassembly so that it is used as such for clamping the conductor; therefore, one does not need any clamping bodies for the purpose of clamping the conductor. As a result, one can save the structural space that is required for these parts and for these subassemblies so that the spring terminal will take up comparatively little structural space and on the whole can be made with very small dimensions. Besides, the number of parts used for the inventive spring terminal is minimized so that supply storage management is good.

In a preferred embodiment the conductor can be arranged by means of the actuation member between the clamping jaws so that the spring terminal by means of the conductor itself can be adjusted from the shifting state to the clamping state. In another preferred embodiment, the interval between the clamping jaws is, in particular, reversible and changeable. As a result, the spring terminal can be switched from the shifting condition into the clamping condition. The shifting is done preferably by means of the actuation member.

Preferably, the clamping jaw is made as a spring, in particular, as a leaf spring. During the adjustment of the contact part, especially during the clamping of the conductor, the clamping jaws therefore are tensed due to their spring properties and during resetting, especially during the removal of the conductor are relaxed. Therefore, no additional springs are needed for the clamping of the conductor so that one can also get along without those springs and so that the needed structural space is very small.

Preferably, the clamping jaw is reversibly adjustable from the shifting state into the clamping state so that the conductor can again be separated out of the spring terminal.

In a preferred embodiment, the spring terminal comprises an adjusting means with which the actuation member cooperates. The adjusting means is preferably provided on the housing part or on the contact part, in particular, on each of the clamping jaws, and makes it possible at least partly to alter the interval between the clamping jaws so that by using the clamping means, one can adjust the spring terminal from the clamping state into the shifting state and back again. With the help of the actuation member, even when the spring terminals have very small practical shapes, it is very easily possible to connect the conductor. The adjusting means is executed as a wedge in a particularly preferred manner.

Preferably, several spring terminals can be lined up one against the other so that they will form a terminal block, in particular, a terminal front block.

In a preferred version, the contact part comprises two clamping jaws between which the conductor can be clamped. Preferably, by clamping the conductor between the clamping jaws, one can at the same time fasten the housing part upon the contact part. The conductor them works as fastening means between the housing part and the contact part so that no further fastening means are needed.

Preferably, the clamping jaws are essentially arranged v-shaped or essentially u-shaped with respect to each other, whereby the clamping of the conductor with the contact part preferably takes place in a form-locking manner.

The actuation member is preferably provided at an angle or parallel to an insertion direction of the conductor.

In a preferred embodiment, the insertion opening is provided on the housing part. As an alternative, the insertion opening can be provided on the contact part. Furthermore, the insertion opening is arranged on a rocker arm that, in particular, can be reset in an elastic manner. In a preferred embodiment, the rocker arm can be rotated around a rotation axis. In this embodiment, the direction of actuation for the actuation member can be provided in an angle, in particular, a right angle with respect to the insertion opening of the conductor into the spring terminal.

In a preferred embodiment, the housing part, when in the shifting state, is not arranged on the contact part. Then the contact part and the housing part are not assembled against each other in the context of the production process. Assembly during the production process is thus omitted so that the terminal spring can be produced in a very reasonably priced manner.

In a particularly preferred manner, by clamping the electrical conductor together with the contact part, the housing part can be fastened upon the contact part. Because the housing part is fastened first by the connection of the conductor in the contact part, one can furthermore get along without parts or without structural measures with regard to the fastening of the contact part in the housing part. That eliminates the terminal assembly of the contact part upon the housing part, and the production of the spring terminal becomes very simple and very cost favorable.

In a preferred manner, the shape of the housing part is so executed in a manner corresponding to the contact part that one can arrange the housing part upon the contact part, whereby, if the conductor is clamped no the contact part, the removal of the housing part from the contact part is no longer possible without the separation of the conductor.

In a further preferred embodiment, the spring terminal comprises an insulation busbar upon which is preferably arranged a guide peg for the guidance of the housing part. That signifies the positioning of the housing part upon the contact part.

In a likewise preferred embodiment, there is arranged on the housing part a stop means so that the housing part can be shifted upon the contact part. In a particularly preferred manner, the stop means are so provided that they will prevent the separation of the housing part from the contact part.

In another preferred embodiment, the contact part is made in the shape of a box. In a particularly preferred manner, the housing part can be inserted into the contact part. This embodiment facilitates a very compact design of the inventive spring terminal.

BRIEF DESCRIPTION OF THE DRAWINGS

Other objects and advantages of the invention will become apparent from a study of the following specification, when viewed in the light of the accompanying drawing, in which:

*Figs.* 1*a*- 1*e* are perspective view of a first embodiment of the electrical connector arrangement of the present invention;

FIGS. 3*a*- 3*d* are perspective views of a third embodiment of the invention;

FIGS. 7*a* and 7*b* are perspective views of another embodiment of the invention;

DETAILED DESCRIPTION OF THE INVENTION

Figure 1A:
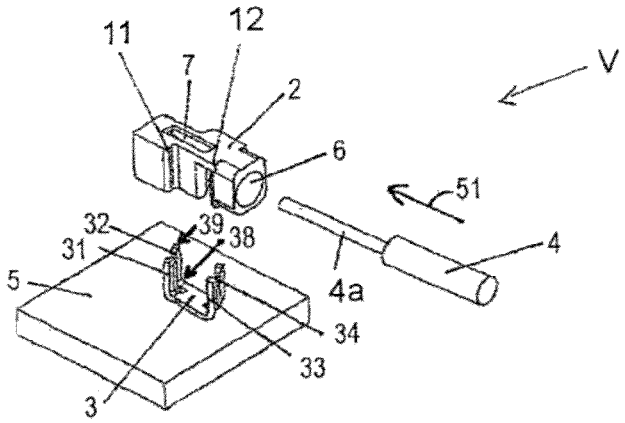
Figure 1B:
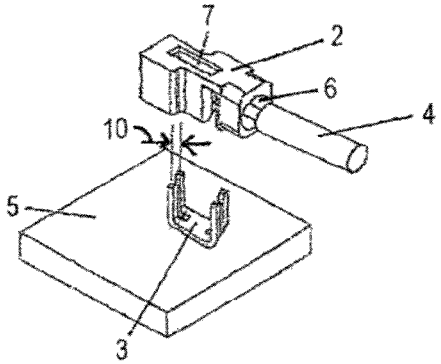
Figure 1C:
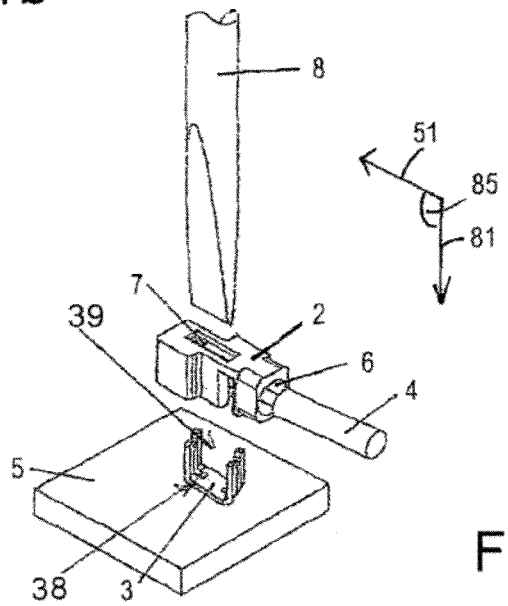
Figure 1D:
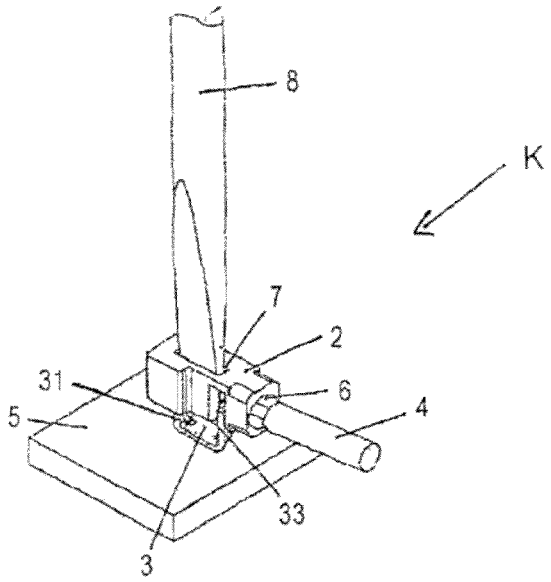

Referring first to the embodiment shown in *Figs.* 1*a*- 1*e*, the electrical connector or spring terminal 1 of the present invention includes a housing 2 for connecting the bare end 4*a* of an insulated conductor 4 with a resilient contact arrangement 3 mounted on an electrical subassembly 5. The housing 2 contains a conductor insertion opening 6 through which the bare end of the conductor 4 is inserted in the insertion direction 51 into the housing 2. Furthermore, the housing 2 contains a tool insertion opening 7 for receiving an actuation member 8 inserted in the actuation direction 81. Then spring terminal 1 is shown in an assembling shifting state V, wherein conductor 4 is not yet attached to the contact arrangement 3. In this embodiment, conductor 4 furthermore in the shifting state can be inserted through the insertion opening 6 into housing part 2.

The shape of housing 2 and the shape of contact arrangement 3 are so related that the arrangement of housing 2 on contact arrangement 3 can be accomplished in a very simple manner with an actuation member 8. Specifically, the tip of the actuation member 8 in this embodiment is introduced through the tool insertion opening 7 into housing part 2, and during the arrangement of housing 2 on contact assembly 3, the contacts extend into corresponding pairs of contact openings 11, 11 and 12, 12 in the housing, and during the clamping operation, the housing causes the contact pairs to be clamped to the conductor 4. Besides, during the fitting of housing part 2 upon contact part 3, respectively during the clamping of conductor 4 between clamping contacts 31, 32, 33, 34, the actuation member 8 is inserted into the spring terminal arrangement 1 at a right angle 85 with respect to insertion direction 51 of conductor 4, so that actuation direction 81 is arranged at a right angle with respect to insertion direction 51.

If housing 2 is arranged on contact arrangement 3 with the help of actuation member 8 during the assembling shifting state V with conductor 4 inserted in housing part 2, then conductor 4 is clamped between clamping jaws 31, 32, 33, 34 of contact part 3. Spring terminal 1 is then in a clamping state K.

According to the invention, the contact arrangement 3 is provided both in a current conducting manner and also for the clamping of an electrical conductor 4. In this case, contact arrangement 3 includes four rod-shaped clamping jaws 31, 32, 33, 34, of which two, in each case, are spaced apart from each other and are therefore essentially arranged neighboring each other in a U-shaped manner. Clamping jaws 31, 32, 33, 34, therefore, have a closed side 38 upon which the adjoining clamping jaws 31, 32, 33, 34 are connected with each other, and an open side 39. To facilitate clamping of the electrical conductor 4, clamping jaws 31, 32, 33, 34 are preferably made in a resilient manner.

In this case, actuation member 8 is guided at a right angle 84 with respect to insertion direction 51 of conductor 4; therefore, clamping jaws 31, 32, 33, 34 during the clamping are forced apart on their open side 39 by conductor 4 so that the interval 10 between two neighboring clamping jaw pairs 31, 32, 33, 34 will become larger.

In the insertion process, clamping jaws 31, 32, 33, 34 simultaneously clamp housing 2 upon contact arrangement 3 so that the housing 2 can no longer be removed from contact part 3 without the separation of conductor 4. Therefore, by clamping conductor 4 with contact arrangement 3, housing 2 is attached upon the conductor 4. In other words, with conductor 4 being inserted due to the shifting of housing 2 that in the assembling shifting state V is not arranged on contact arrangement 3, not only will conductor 4 be clamped together with contact arrangement t 3, but the housing 2 will also be attached upon contact arrangement 3.

Figure 1E:
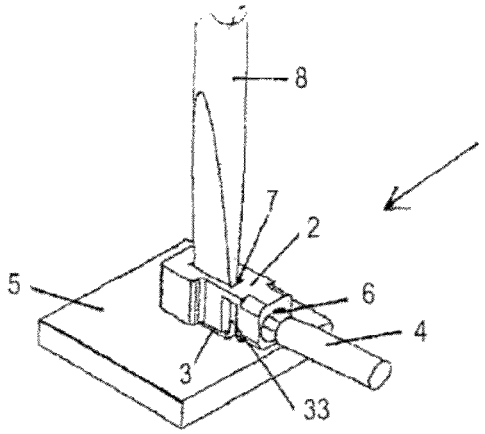

In the spring terminal 1 shown here, we are dealing with a front terminal that can be lined up in succession. FIGS. 1*a*-1*d* show spring terminal 1 in the shifting state V in which conductor 4 can be shifted in housing part 2. In FIG. 1*e*, spring terminal 1 is in the clamping state K in which conductor 4 is clamped together with contact arrangement 3 and electrically engages the latter.

Figure 2A:
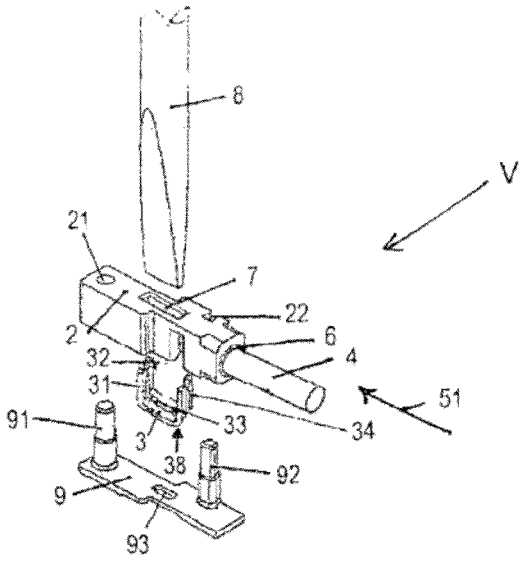
FIGS. 2*a*- 2*d* are perspective views of a second embodiment of the invention.
Figure 2B:
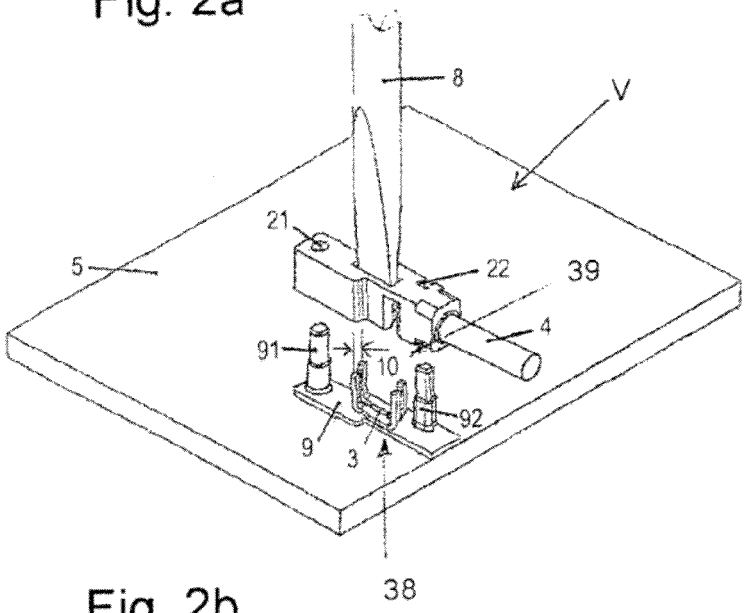
Figure 2C:
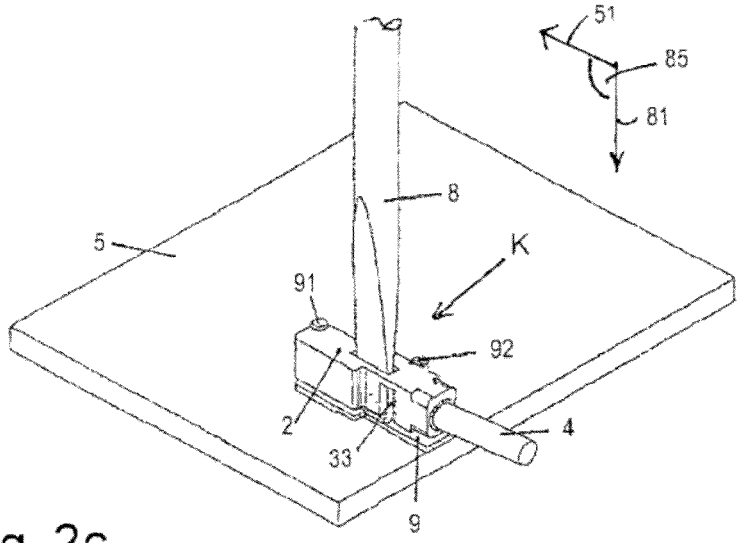
Figure 2D:
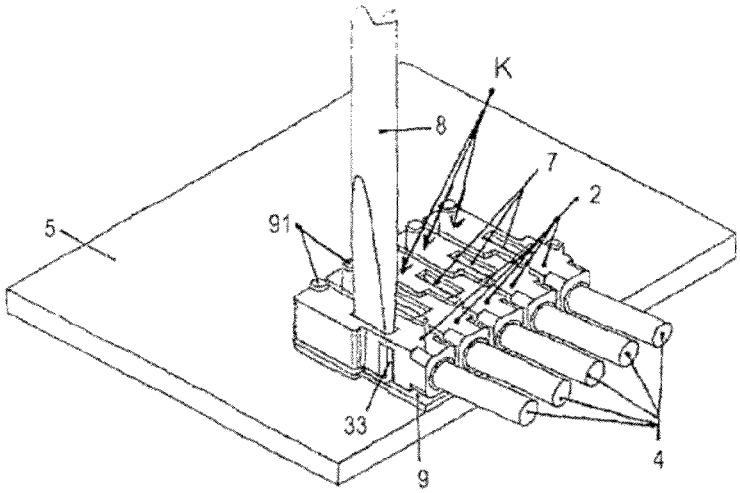

FIGS. 2*a*-2*d* illustrate a second embodiment of the inventive spring terminal 1. Here again, FIGS. 2*a* and 2*b* illustrate the arrangement of housing part 2 of spring terminal 1 upon contact part 3 as well as the clamping of conductor 4 in contact part 3, in the shifting state V, and FIGS. 2*c* and 2*d* illustrate the apparatus in the clamping state K.

This embodiment differs from the embodiment of FIGS. 1*a*-1*e* in that, between conductor plate 5 and contact part 3, there is provided an insulation member 9. Insulation member 9 contains an opening 93 that affords electrical connection between the contact arrangement 3 and the circuits on the printed circuit board 5. Here, the connection means (not shown) extends from contact assembly through the opening 93. Furthermore, the insulation member 9 includes guide pegs 91, 92, which, when spring terminal 1 is in the clamping state K, engage corresponding recesses 21, 22 contained in the housing 2. The position of guide pegs 91, 92 and recesses 21, 22 can be adjusted as required in each particular case and differ here in FIGS. 2*a* and 2*b*, and in FIGS. 2*c* and 2*d*.

Referring now to FIGS. 3*a*-3*d*, a third embodiment of the inventive spring terminal 1 is shown, including a housing 302 for connecting the bare end of a conductor 4 to a contact arrangement 303, mounted on a printed circuit board base 5. In the assembling shifting state V of FIGS. 3*a*-3*c*, the conductor 4 can be displaced in housing part 2 and is not clamped between clamping jaw contacts 331, 332, whereas in the clamping state K of FIG. 3*d*, the conductor 4 is clamped between clamping jaws 331, 332 of the contact assembly 303.

As in the embodiments of FIGS. 1 and 2, the shape of housing part 302 and the shape of contact assembly 303 are so executed in a manner corresponding to each other that it is possible to arrange housing part 302 upon contact assembly 303, in particular, with the help of contact adjusting means 325.

In the embodiment of FIGS. 3*a*-3*d*, the contact assembly includes only two clamping jaw contacts 331, 332, which essentially are arranged in V-shape with respect to each other and which are executed as resilient members, in this case as leaf springs. In the following, the terms "clamping jaw contacts" and "leaf spring contacts" are used synonymously. In the assembling shifting state V, leaf springs 331, 332 are spaced apart from each other upon their open side 38, and upon their closed side 39, they are preferably connected with each other. A base portion 303*a* of the contact assembly is connected with the printed circuit board 5.

Regarding the handling of spring terminal 1, this arrangement shows a difference with respect to the embodiments in FIGS. 1 and 2 during the connection of conductor 4.

In order to be able to clamp conductor 4 between leaf springs 331, 332, the interval 10 between leaf springs 331, 332 on their closed side 39 must first of all be enlarged. Then conductor 4 is placed between leaf springs 331, 332, and subsequently interval 10 again is reduced until leaf springs 331, 332 come to rest against conductor 4 and clamp the latter. Starting with the leaf springs 331, 332, which initially rest against each other in FIG. 3*a*, the interval 10 between leaf springs 331, 332 in clamping state K in which conductor 4 is arranged between them is enlarged.

This embodiment, above all, offers the advantage that conductor 4, by widening the interval 10 between leaf springs 331, 332 with respect to each other, can again be taken out of spring terminal 1 and that in the process, due to the resetting forces of leaf springs 331, 332, there will be no deformations so that spring terminal 1 can be used again.

To alter the interval 10 between leaf springs 331, 332, housing part 2 has an adjusting device 325, here in the form of a wedge, which, with the help of actuation member 8, can be inserted between leaf springs 331, 332. The insertion opening 7 for actuation member 8 is provided on a particularly resilient rocker arm 327 so that actuation member 8 in the actuation direction 81 is actuated at a right angle 85 with respect to insertion direction 51, whereby adjusting means 325 is inserted between leaf springs 331, 332 on the closed side 39. The insertion opening 7 for actuation member 8 is provided here on adjusting means 325. In order starting from mutually adjoining leaf springs 331, 332 to be able to insert adjusting means 325 between leaf springs 31, 32, the latter are bent outward on their side that faces toward adjusting means 25 so that adjusting means 325 engages between leaf springs 331, 332.

The embodiments of FIGS. 4-9 also include spring terminals 1 with contact assemblies 3, there, in each case, with two clamping jaws defined by mutually V-shaped arranged leaf spring contacts. In these embodiments, there are also provided in each case adjusting means in order first of all to increase the interval of leaf spring contacts from each other starting with the assembling shifting state V so as then to insert conductor 4 and then to reduce the interval until conductor 4 in clamping state K is clamped between the leaf spring contacts. Of course, spring terminals 1 in FIGS. 4-7 and 9 are so provided that actuation member 8 and conductor 4, upon insertion and clamping of conductor 4, are arranged somewhat parallel with respect to each other between the leaf spring contacts.

Therefore, in FIGS. 4*a*-4*g*, there is provided in each case an adjusting means 435, 436 on each leaf spring 431, 432, whereby the adjusting means 435, 436 in each case are so arranged with respect to each other in the form of a wedge that the tip of the actuation tool 8 can be inserted via the longitudinal tool passage 7 on the open side 38 between adjusting means 435, 436, and on the closed side 39 will in the process increase interval 10 between leaf springs 431, 432.

Figure 4A:
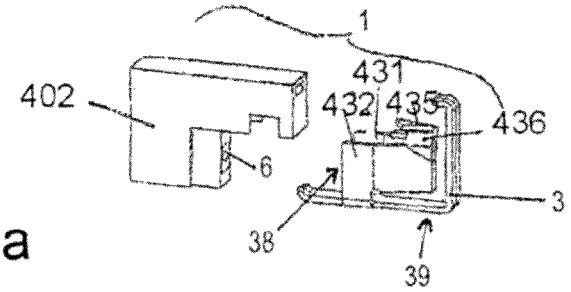
FIGS. 4*a*- 4*g* are perspective view of a fourth embodiment of the invention.
Figure 4B:
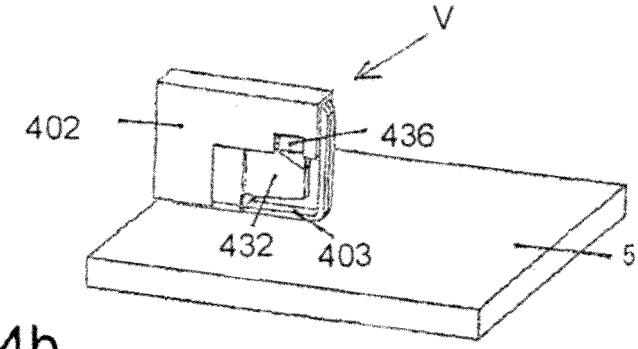
Figure 4C:
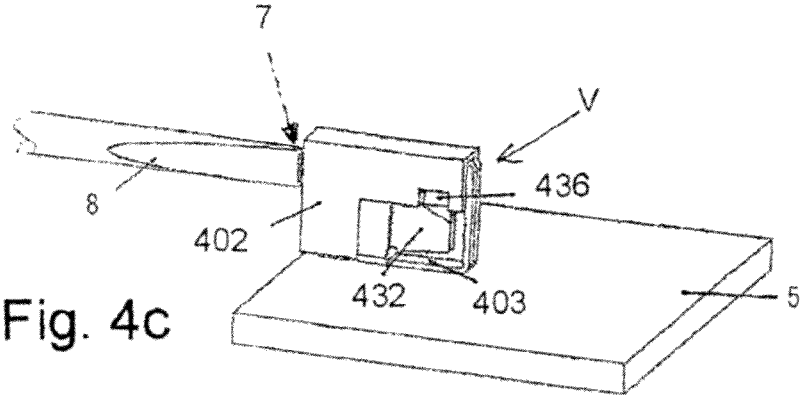
Figure 4D:
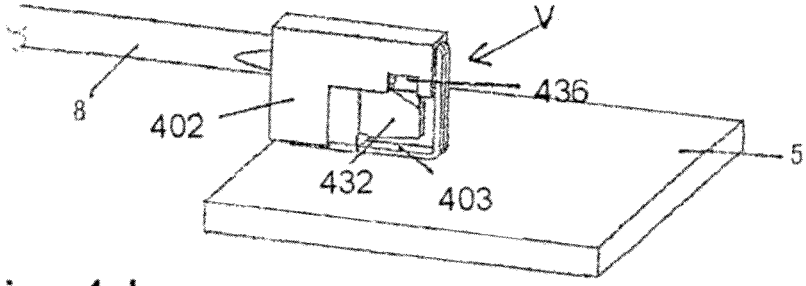
Figure 4E:
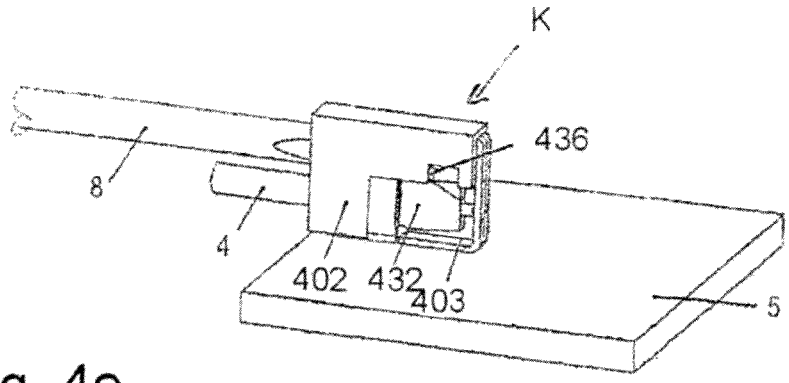
Figure 4F:
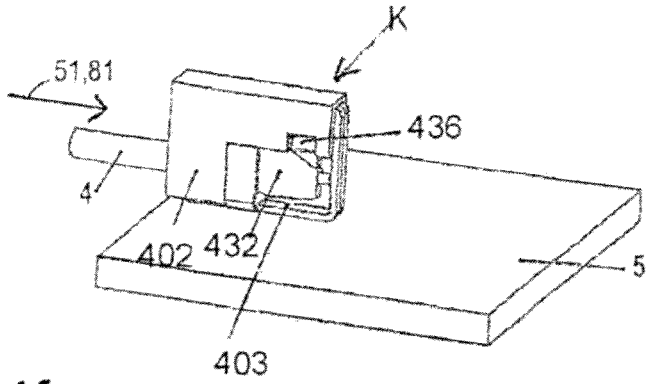
Figure 4G:
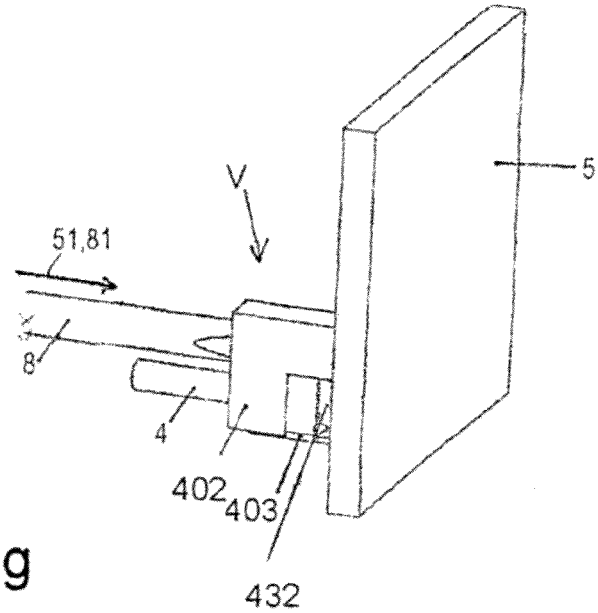
Figure 5A:
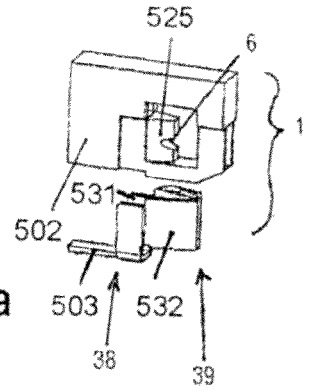
FIGS. 5*a*- 5*g* are perspective views of a fifth embodiment of the invention.
Figure 5B:
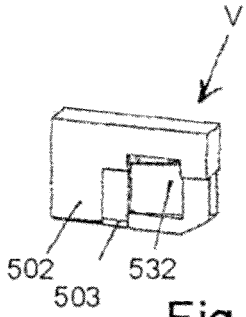
Figure 5C:
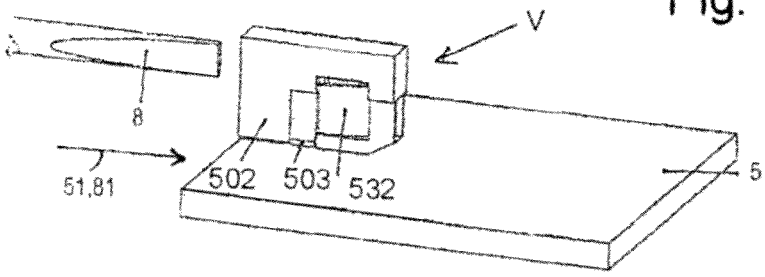
Figure 5D:
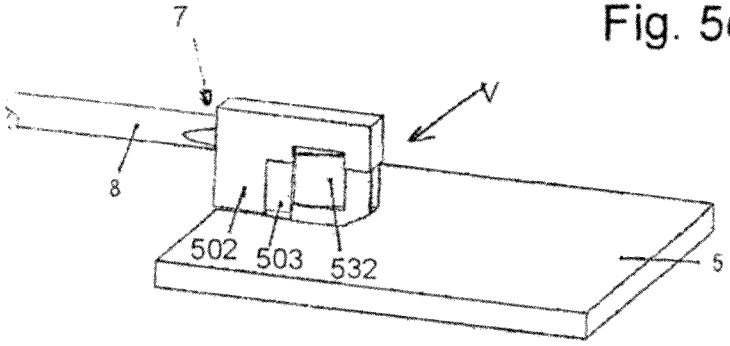
Figure 5E:
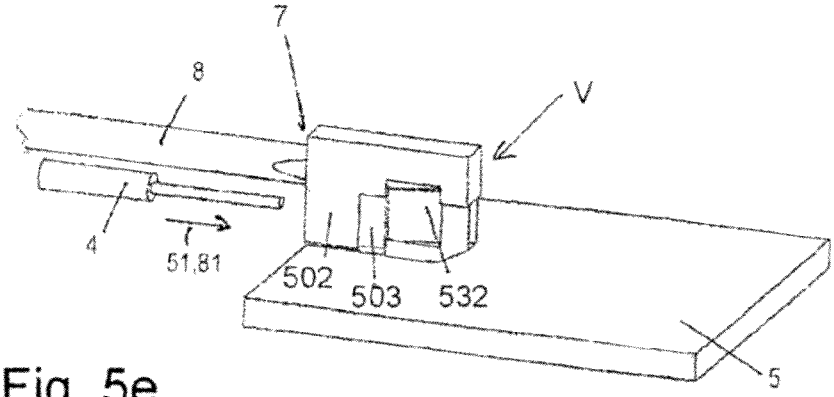
Figure 5F:
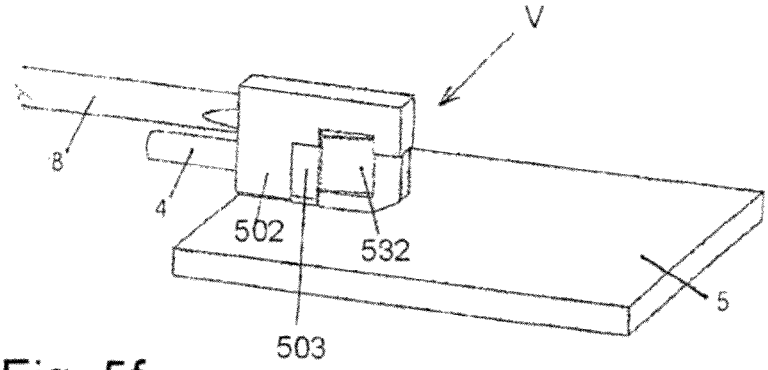
Figure 5G:
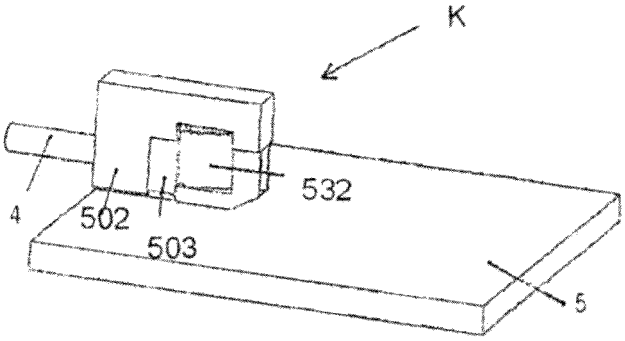

FIG. 4*a* shows housing part 402 and contact part 403 separate from each other, FIGS. 4*b*-4*e* show spring terminal 1 in the shifting state V, and FIG. 4*f* shows spring terminal 1 in clamping state K.

In the embodiment of FIG. 4, spring terminal 1 offers the advantage that, owing to the generally L-shaped configuration of the contact assembly 403, the arrangement of spring terminal 1 upon printed circuit board 5 is possible both in an alignment parallel to an insertion direction 51 of conductor 4 into housing part 2, and in an alignment normal with respect to insertion direction 51. More particularly, FIG. 4*g* shows the arrangement of spring terminal 1 upon a printed circuit board 5, which is arranged normal with respect to insertion direction 51 of conductor 4.

In the embodiment of FIGS. 5*a*-5*g*, a wedge-shaped adjusting means 525 is arranged for displacement on housing 502.

Actuation direction 81 for actuation tool 8 via opening 7 is provided parallel to insertion direction 51 of conductor 4, so that adjusting means 525 is guided in actuation direction 81 starting from the open side 38 between leaf spring contacts 531, 532 until the latter are pressed apart from each other on their closed side 39 and conductor 4 can be inserted between leaf spring contacts 531, 532. Adjusting means 525 is preferably provided in a resilient return fashion by return spring means (not shown), so that upon retraction of actuation tool 8 against actuation direction 81, adjustment will take place likewise against actuation direction 81. In the process, leaf spring contacts 531, 532 are also restored until they rest against conductor 4 and clamp the latter.

In the embodiment of FIGS. 6*a*-6*e*, a rotatable wedge 625 is arranged on the housing 602 and has a generally oval cross-sectional configuration, thereby defining an adjusting means between the leaf spring contacts 631 and 632. For this purpose, the leaf spring contacts include on their closed side 39 in each case an extension portion 612, 622 between which the adjusting means 625 is arranged. Therefore, the interval 10 between leaf spring contacts can be enlarged on their closed side 39 upon rotation of the adjusting means. Here again, the rotation is done by means of actuation member 8, which is inserted parallel to insertion direction 51 of conductor 4 into the insertion opening. Here again, after the insertion of conductor 4 between the leaf spring contacts 631 and 632 by turning adjusting means 625 back, leaf springs 631 and 632 are released until they rest in clamping engagement against conductor 4.

Figure 6A:
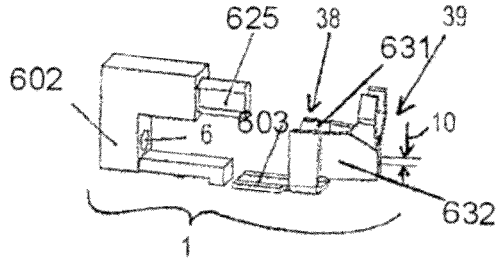
FIGS. 6*a*- 6*e* are perspective views of a sixth embodiment of the invention.
Figure 6B:
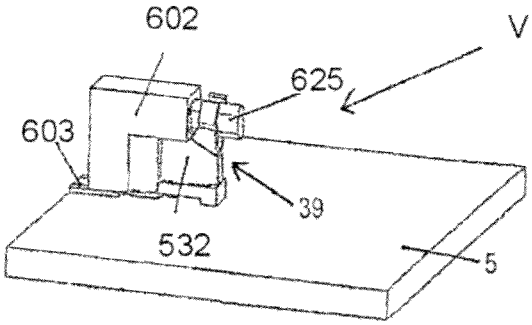
Figure 6C:
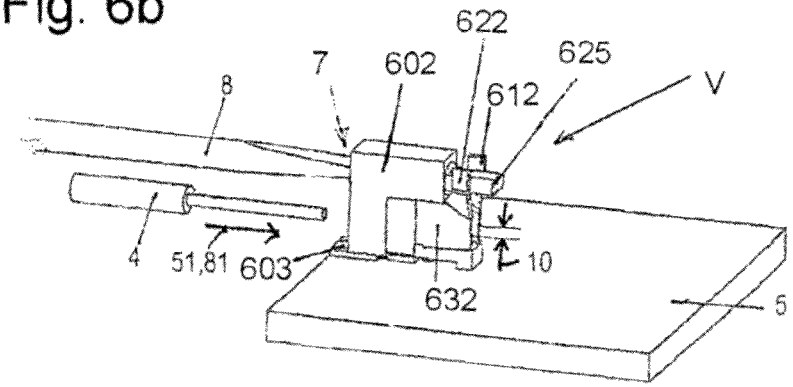
Figure 6D:
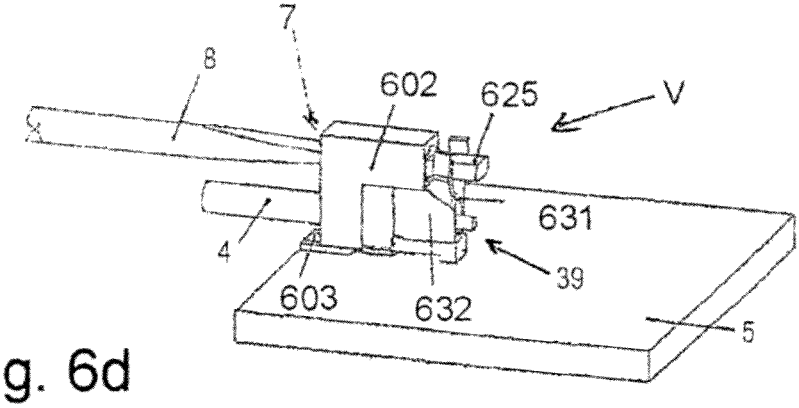
Figure 6E:
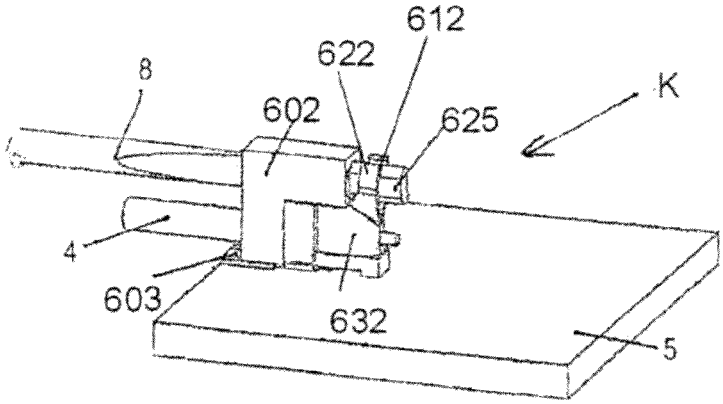

FIG. 6*a* shows the housing 602 separate from each other, FIGS. 6*b*-6*d* show the spring terminal 1 in the adjusting state V, and FIG. 6*e* shows spring terminal 1 in the clamping state K.

FIGS. 7*a*-7*b* similarly illustrate a modification of spring terminal 1 for two conductors 4, whereby in this case, for each conductor 4, there are provided in each case two pairs of adjacent V-shaped leaf spring contacts 731, 732 and 733, 734, with only one adjusting means 725 is provided on housing 702 for the purpose of altering interval 10 of the closed side 39 of leaf spring contacts 731, 732 and 733, 734 from each other. Therefore, interval 10 of leaf spring contacts 731, 732, 733, 734 from each other can be adjusted here simultaneously for both conductors 4.

FIG. 7*a* shows spring terminal 1 in the clamping state K, and FIG. 7*b* shows spring terminal 1 in the disassembled shifting state V, wherein the conductors 4 are separated from the spring terminal 1.

Figure 8A:
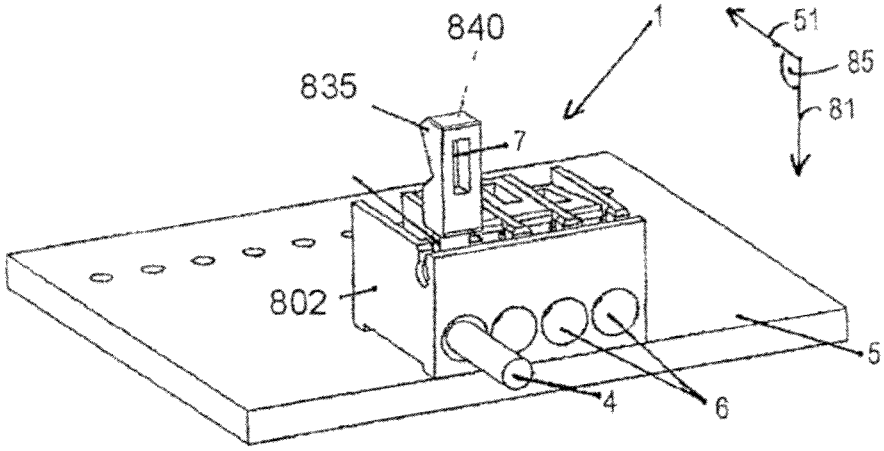
FIGS. 8*a*and 8*b* are perspective views of a further embodiment.
Figure 8B:
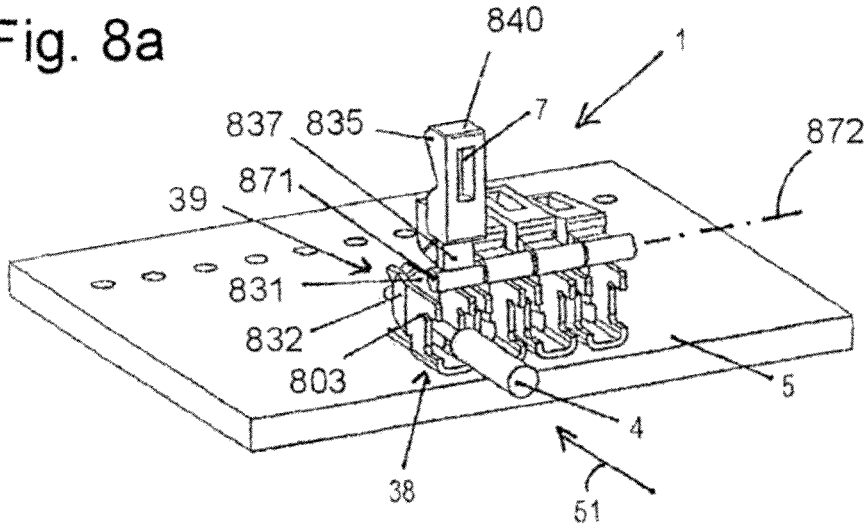

FIGS. 8*a* and 8*b* illustrate an eighth embodiment of the inventive spring terminal, including a wedge-shaped adjusting means 835 arranged on the pivotable rocker arm 840 of contact assembly 803. Rocker arm 840 is pivotally connected with contact assembly 803 by means of a hinge 871 and can be swung around a pivot axis 872. Insertion opening 7 contained in the rocker arm 840 is adapted to receive the tip of the actuation tool 8, which, upon actuation, opens contact part 3.

Leaf spring contacts 831, 832, analogous to those of the embodiment of FIG. 3, are connected in a V-shaped fashion and have an open side 38 and a closed side 39, whereby in the shifting state V on the open side 38, they are spaced apart from each other, and on the closed side 39, they rest against each other.

Starting from adjoining leaf spring contacts 831, 832, in order to be able to insert adjusting means 835 between leaf springs 831, 832, the latter are bent outwardly on their sides facing the adjusting means 835.

To actuate adjusting means 835 by means of actuation member 8, the latter is so displaced that it will be arranged parallel to the insertion direction 51 of conductor 4, so that it will engage between leaf spring contacts 831, 832. Actuation member 8 is actuated in the actuation direction 81 at a right angle 85 with respect to insertion direction 51. Then adjusting means 835 can be inserted on closed side 39 between leaf spring contacts 831, 832 so that interval 10 (see FIG. 3) of leaf springs 831, 832 with respect to each will become greater.

Conductor 4 is guided from open side 38 between the two leaf spring contacts 831, 832 until it is arranged on closed side 39 between leaf springs 831, 832.

Rocker arm 837 is preferably connected in a resilient manner, so that during the resetting of actuation member 8 against actuation direction 81, it will swing back. As the result, leaf spring contacts 831, 832 at their closed end 39, are also reset so that their interval again will be reduced until leaf spring contacts 831, 832 rest against conductor 4 and clamp the latter.

FIGS. 9*a*-9*i* illustrate a ninth embodiment of an inventive spring terminal 1 for connecting a conductor 4 with an electrical subassembly or printed circuit board 5.

Contact part 3 of spring terminal 1 is made in the shape of a box and therefore has four box walls 931, 932, 933, 934, which essentially are arranged at a right angle with respect to each other. In two opposite box walls 931, 932, there are provided two clamping jaw contacts 935, 936, which are arranged in V-shaped fashion with respect to each other, whereby clamping jaw contacts 935, 936 on their closed side 39 point into the interior of contact assembly 903. For connection with an electrical subassembly 5, contact assembly 903 furthermore has two contact feet 951, 952, which are bent outwardly from box wall 934.

It will be apparent that an embodiment of contact assembly 903 with only one clamping jaw 935 is also possible, in which case conductor 4 can be clamped between clamping jaw 935 and the opposite box wall 932.

With a first end 923, which can be stuck into contact assembly 903, housing 902 can be inserted into the interior of contact assembly 903. It has a second end 924 that cannot be inserted into contact assembly 903 upon which are arranged the insertion opening 6 for conductor 4 as well as the insertion opening 7 for actuation member 8. Insertion opening 7 and insertion opening 6 are so arranged with respect to each other that actuation member 8 in an actuation direction 81 can be actuated parallel to the insertion direction 51 of conductor 4. Conductor 4 is guided starting from the open side 38 of contact assembly 903 between clamping jaws 935, 936.

Housing 902 has adjusting means 925 which, upon activation of the actuation member 8 in actuation direction 81, is inserted between clamping jaws 935, 936. As a result, clamping jaws 935, 936 on their closed side 39 are pressed apart from each other so that conductor 4 can be inserted between clamping jaws 935, 936.

During the retraction of actuation member 8 against actuation direction 81, clamping jaws 935, 936, due to their reset force, are reset. In the process, conductor 4 is clamped between clamping jaws 935, 936. Housing 902 in the process is also shifted against actuation direction 81.

On the first end, which can be inserted into contact assembly 903, stop means 928 (FIG. 9*a*) are provided on housing 902. After insertion into contact assembly 903 against actuation direction 81, housing 902 therefore can be pulled out of contact assembly 903 only so far until the stop means 928 rest against contact assembly 903. Because housing 902 by means of stop means 928 is attached upon contact assembly 903, it cannot automatically be separated from contact assembly 903 during the shifting action against the actuation direction 81.

Figure 9A:
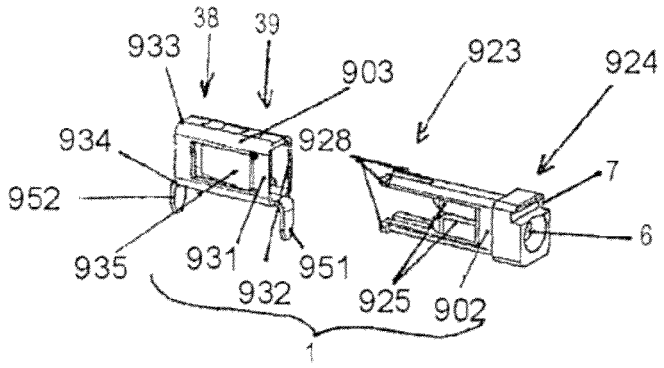
FIGS. 9*a*- 9*g* are perspective views of a still another embodiment of the invention.
Figure 9B:
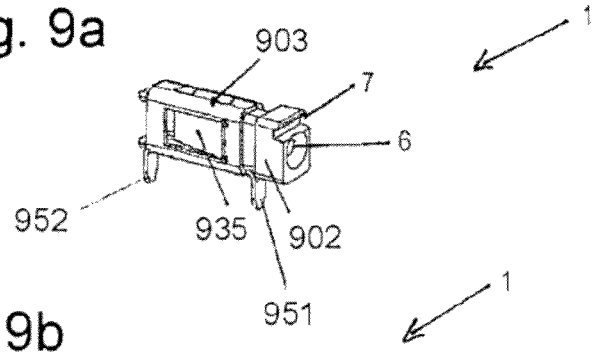
Figure 9C:
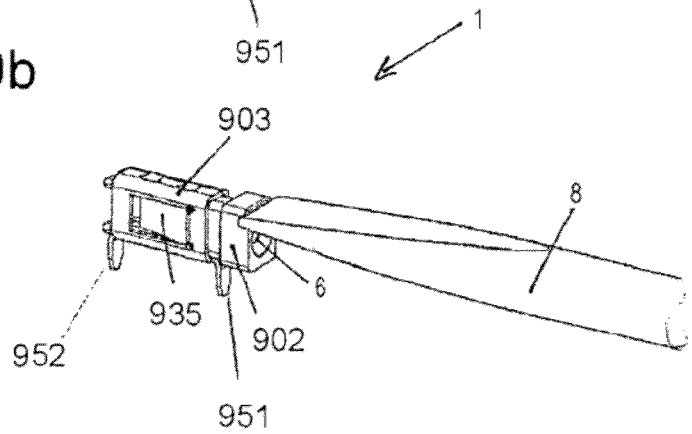
Figure 9D:
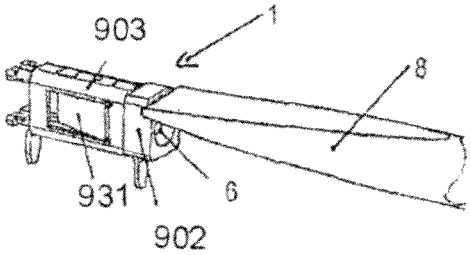
Figure 9E:
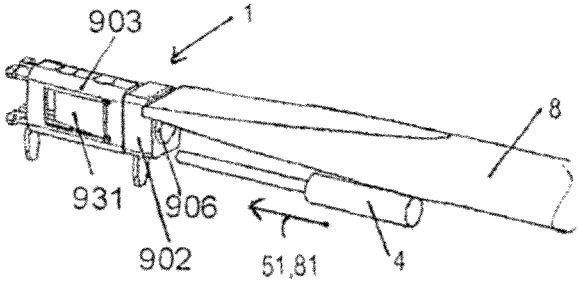
Figure 9F:
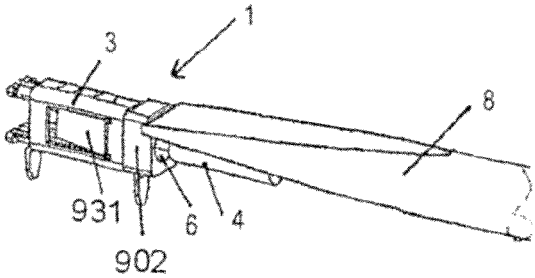
Figure 9G:
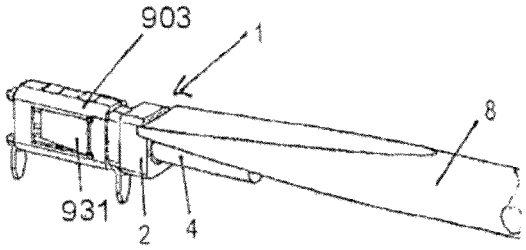
Figure 9H:
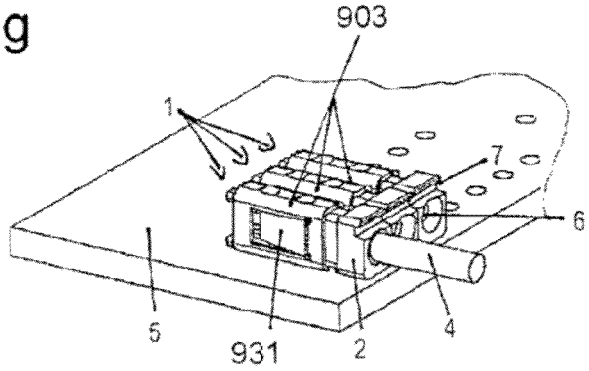
FIG. 9*h* illustrates a plurality of the devices of FIG. 9*g* mounted on a support.
Figure 9I:
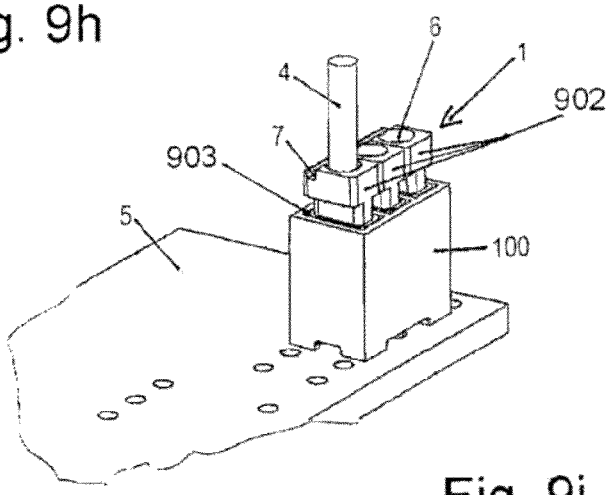
FIG. 9*i* is a modification of the apparatus of FIG. 9*h*.

In the modification of FIG. 9*i*, a second insulating housing part 100 is provided around contact part 3.

A screwdriver 8 can be used advantageously as actuation member in all embodiments. Housing 2 is preferably formed from an insulating material, in particular, a synthetic plastic substance.

Contact assembly 3 is formed from a conductive material, in particular, a metal or a metal alloy. The resilient clamping jaws 31, 32, 33, 34 are preferably made of a metal with good restoring properties. Because clamping jaw contacts 31, 32, 33, 34 furthermore conduct current, the preferred material at the same time has good conductive properties. The inventive spring terminal can be made with miniaturized dimensions.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector (1) for connecting the bare end (4*a*) of an insulated conductor (4) with a circuit on a printed circuit board (5), comprising:

(a) a horizontal printed circuit board (5) having an electrical circuit thereon;

(b) an electrically conductive contact device (3) mounted on, and electrically connected with the circuit of, said printed circuit board, said contact device including at least two spaced resilient contacts (31, 32; 33, 34) having adjacent end portions that are biased together;

(c) a housing (2) formed from an electrically insulating material, said housing containing a conductor opening (6) for receiving the conductor bare end; and (d) positioning means for positioning the conductor bare end in a clamped position between said contact end portions, said positioning means being arranged for operation by an actuating tool (8).

2. An electrical connector as defined in claim 1, wherein said contacts are parallel and extend vertically upwardly relative to said printed circuit board; and further wherein said housing is arranged above said contact arrangement, said housing having:

(1) a horizontal longitudinal axis containing said conductor opening for collinearly receiving the conductor bare end in a horizontal first direction (51);

(2) said housing containing a second opening (7) for receiving the tip of an actuating tool (8), said second opening being orthogonally arranged relative to said first opening, whereby said housing may be displaced downwardly in an orthogonal second direction (81) by said actuating tool toward said contact device, thereby to cause said contacts to extend through third openings (11, 12) contained in said housing into diametric clamping engagement with the conductor bare end.

3. An electrical connector as defined in claim 2, wherein said contact device comprises two pairs of contacts (31, 32; 33, 34) arranged in longitudinally spaced relation relative to said housing.

4. An electrical connector as defined in claim 3, and further including:

(e) a horizontal planar insulation member (9) arranged between said printed circuit board and said contact device, said insulation member containing an opening (93) affording electrical connection between said contact device and said printed circuit board, said insulation member including a pair of vertically upwardly extending guide pegs (91, 92) arranged for cooperation with corresponding vertical guide openings (21, 22) contained in said housing, thereby to guide said housing during the vertical downward movement thereof relative to said contact device.

5. An electrical connector as defined in claim 1, wherein said contact device comprises a pair of leaf spring contacts having a generally V-shaped arrangement; and further including:

(e) contact adjusting means for adjusting the spacing distance (10) between said contact ends prior to the insertion of the conductor bare end therebetween.

6. An electrical connector as defined in claim 5, wherein said contact adjusting means (435, 436; 835) are arranged on said contacts.

7. An electrical connector as defined in claim 6, wherein said leaf springs (431, 432) include angularly-arranged integral wing portions (435, 436) arranged opposite the actuating tool opening (7), said wing portions being so arranged that the distance between the adjacent ends of the leaf spring contacts is increased by the insertion of the tip of the actuation tool between said wing portions.

8. An electrical connector as defined in claim 7, wherein said contact device (403) is generally L-shaped, thereby to permit alternate connection of said contact device to a vertically arranged printed circuit board and to a horizontally arranged printed circuit board, respectively.

9. An electrical connector as defined in claim 6, wherein said contact adjusting means comprises a wedge member (835) arranged on a pivotally-connected rocker arm portion (840) of said contact arrangement (803).

10. An electrical connector as defined in claim 9, wherein a bank of said contact arrangements is provided within a single housing (802), the rocker arm portions of all of said contact arrangements being pivotable about a common pivot axis (872).

11. An electrical connector as defined in claim 5, wherein said contact adjusting means (325; 525; 625; 725; 925) are arranged on said housing.

12. An electrical connector as defined in claim 11, wherein said housing includes a resilient pivotally-connected rocker arm portion (327) arranged adjacent said leaf spring contacts (331, 332); and further wherein said contact adjusting means comprises a wedge (325) carried by said rocker arm portion adjacent said leaf springs, said rocker arm portion containing said actuating member opening for operation by the actuating tool in a direction (81) normal to the conductor axis (51).

13. An electrical connector as defined in claim 11, wherein said contact adjusting means comprises a wedge member (525) mounted for sliding displacement on said housing, said wedge member being displaceable by said actuating tool to vary the distance between the adjacent ends of said leaf spring contacts (531, 532).

14. An electrical connector as defined in claim 11, wherein said contact adjusting means comprises a wedge member (625) mounted for rotation in said housing by the actuating tool, said wedge member having a non-circular cross-sectional configuration; and further wherein said leaf spring contacts (631, 632) include integral wing portions (612, 622) extending on opposite sides of said wedge member.

15. An electrical connector as defined in claim 14, wherein said connector includes two sets of leaf spring contacts (731, 732; 733, 734) arranged on opposite sides of said wedge member (725), each of said leaf spring contacts including an integral wing portion operable by said wedge member.

16. An electrical connector as defined in claim 11, wherein said contact assembly (903) includes a box-shaped enclosure (931, 932, 933, 934) surrounding said leaf spring contacts (935, 936); and further wherein said housing (902) is insertable longitudinally within said enclosure, said housing including a wedge device (925) arranged for insertion between said leaf spring contacts.

17. An electrical connector as defined in claim 16, wherein said housing includes stop means (928) for limiting the extent of insertion of said housing within said enclosure.

18. An electrical connector as defined in claim 17, and further including a bank of said connectors (902) mounted on said printed circuit board (5), and a second housing(100) enclosing said bank of connectors.

19. An electrical connector (1) for connecting the bare end (4*a*) of an insulated conductor (4) with a circuit on a printed circuit board (5), comprising:

(a) a horizontal printed circuit board (5) having an electrical circuit thereon;

(b) an electrically conductive contact device mounted on, and electrically connected with the circuit of, said printed circuit board, said contact device including at least two spaced resilient leaf-spring contacts having adjacent end portions that are biased together;

(c) a housing formed from an electrically insulating material, said housing containing a conductor opening for receiving the conductor bare end; and (d) positioning means for positioning the conductor bare end in a clamped position between said contact end portions, said positioning means being arranged for operation by an actuating tool, said positioning means including a wedge (325;435, 436; 525; 625; 725; 835; 925) for separating said resilient leaf-spring contacts.

* * * * *